US006678896B2

(12) United States Patent
Robinson et al.

(10) Patent No.: US 6,678,896 B2
(45) Date of Patent: Jan. 20, 2004

(54) SPORTS TOWEL

(76) Inventors: Aaron E. Robinson, 397 Jefferson St., Daytona Beach, FL (US) 32114; Shawn M. Smith, 2821 NW. 26$^{th}$ Ave., Ft. Lauderdale, FL (US) 33311

( * ) Notice: Subject to any disclaimer, the term of this patent is extended or adjusted under 35 U.S.C. 154(b) by 208 days.

(21) Appl. No.: 09/975,378

(22) Filed: Oct. 11, 2001

(65) Prior Publication Data

US 2003/0074717 A1 Apr. 24, 2003

(51) Int. Cl.$^{7}$ ..... A42B 1/00
(52) U.S. Cl. ..... 2/171.2
(58) Field of Search ..... 2/171, 174, 171.2, 2/207, 208.7, 209.13, 209.14, 202–205, 209.4, DIG. 11, 69, 456, 195.1; 601/79; 602/74–75; 482/10, 11, 93; 607/109, 110, 139

(56) References Cited

U.S. PATENT DOCUMENTS

| | | | | |
|---|---|---|---|---|
| 4,204,543 A | | 5/1980 | Henderson | |
| 4,277,847 A | * | 7/1981 | Florio | 2/12 |
| 4,326,533 A | | 4/1982 | Henderson | |
| 4,648,130 A | * | 3/1987 | Kuznetz | 455/351 |
| 5,305,470 A | | 4/1994 | McKay | |
| 5,594,956 A | | 1/1997 | Barrientos | |
| 5,790,986 A | | 8/1998 | Hall | |
| 5,832,538 A | * | 11/1998 | Williams | 2/202 |
| 5,950,234 A | | 9/1999 | Leong et al. | |
| 6,110,080 A | | 8/2000 | Niv | |
| 6,233,745 B1 | | 5/2001 | Frieson | |

* cited by examiner

*Primary Examiner*—Tejash Patel
(74) *Attorney, Agent, or Firm*—Edward M. Livingston

(57) ABSTRACT

An article of headwear (1), preferably of moisture absorbent cloth, having two narrow end sections (4*a*, 4*b*) and a wide middle section (7) for covering the head and neck of a wearer. The inner side (3) of the middle section (7) contains a pocket (10) near the bottom (9) for holding thermal matter (15), such as frozen liquid or heat pads. An optional semi-circular headband (5) on the inner side (3) of the middle section (7) above the pocket (10) may assist in placing and holding the headwear to a forehead on a person. An optional visor (11) extending from the top portion (8) of the headwear is also provided. The end sections may serve as handles to be held by the hands. Various other fastening means (13*a*, 13*b*, 14*a*, 14*b*, 18*a*, 18*b*, 19*a*, 19*b*) have been provided for securing the headwear to the head of a wearer. The outside (2) of the headwear may also serve as a medium for advertising (6). Cooling relief and protection from the sun, as well as perspiration absorbency, during hot and humid weather, or, alternatively, warming during cold weather is provided by this invention.

18 Claims, 2 Drawing Sheets

SPORTS TOWEL

BACKGROUND OF THE INVENTION

This invention relates to an article of clothing to be placed over the head of an athlete, sports fans and others to provide cooling and protection from the sun during hot weather or, alternatively, warmth during cold weather events.

Persons who exert themselves in hot weather, particularly athletes, but even fans and workers, can become victims of exhaustion and heat stroke, which can even result in death. Also, exposure of the head, face and neck to the sun during outdoor activities can result in sunburn which is a known cause of skin cancer. Even furthermore, during hot weather an athlete or fan tends to perspire excessively, the sweat from which gets in the eyes and can interfere with the activity. On the other end of the spectrum, athletes who participate in cold weather events, such as skiing, ice skating and hockey, or fans of such sports, run the risk of hyperthermia.

Thus, a need exists for a device that will help cool and protect a person during hot weather and exposure to sun or help keep warm a person in cold weather.

The prior patented art includes the following patents:

| U.S. Pat. No. | Inventor | Issue Date |
|---|---|---|
| 6,110,080 | Niv | Aug. 29, 2000 |
| 4,326,533 | Henderson | Apr. 27, 1982 |
| 4,204,543 | Henderson | May 27, 1980 |
| 5,305,470 | McKay | Apr. 26, 1994 |
| 5,790,986 | Hall | Aug. 11, 1998 |
| 5,594,956 | Barrientos | Jan. 21, 1997 |
| 5,950,234 | Leong, et al. | Sep. 14, 1999 |
| 6,233,745 | Friesen | May 22, 2001 |

The Niv patent teaches a therapeutic headpiece containing pockets for placing weights. The two Henderson patents cover headbands containing slits or pockets for holding ice or other freezable liquid. The McKay patent discloses an elasticized sports band for absorbing perspiration which has pockets for holding ice. The Hall patent discloses headwear having a visor with attached cloth for covering the head and neck. The Barrientos patent discloses a head bandana having a head band with hook and loop fastening closure means. The Leong, et al. patent teaches a bowl-shaped cooling pack which fits over the head and has coolant contained therein. Finally, the Friesen patent discloses a net cover which is attachable to a hat.

Although some of the above devices may attempt to resolve the above problems, none of the prior patented art discloses an article of manufacture having a structure with features which provide the advantages of the present invention.

SUMMARY OF THE INVENTION

The primary object of the present invention is to provide an article for cooling athletes, sports fans and others during hot weather.

Another object of the present invention is to provide an article that can be worn by athletes and participants in cold weather sports and events.

An even further object of the present invention is to protect the wearer from sunburn or other adverse affects of exposure to the sun.

Another object of the present invention is to provide an article that can also be used to wipe perspiration from one's face.

An additional object of the present invention is to provide such an article that can be easily stored in a temperature enhanced condition in a freezer or heated in the microwave and reused as needed.

The present invention fulfills the above and other objects by providing an article of headwear made of cloth having a wide middle section for covering the head and neck and two narrower symmetrical end sections forming handles for holding or securing the headwear over the head. The inner side of the headwear contains a pocket into which thermally enhanced packets of material, such as an ice or heat pad can be inserted and held. The inner side of the middle section may contain a semi-circular band positioned above the pocket to assist in retaining the headwear over a forehead of the wearer. An optional visor may extend outward from a front of the top portion of the middle section. The headwear may have hook and loop or snap fastening means on the end and middle sections to help hold the headwear around the head. The thermal matter contained in the packet may consist of frozen liquid or coolant or heated material. The outer side of the headwear may also serve as an advertising medium for display of logotypes or advertising.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
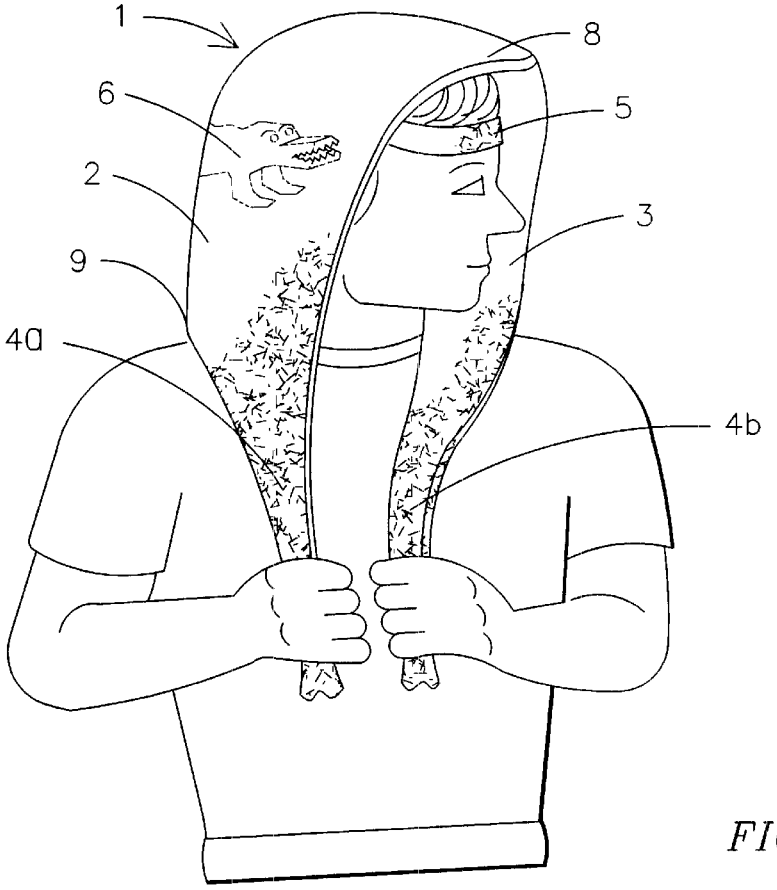
FIG. 1 is a perspective view of the sports towel of the present invention as it would appear while being worn.

For purposes of describing the preferred embodiment, the terminology used in reference to the numbered components in the drawings is as follows:

| | |
|---|---|
| 1. | sports towel, generally |
| 2. | outer side |
| 3. | inner side |
| 4a,b. | end sections |
| 5. | headband |
| 6. | logotype |
| 7. | middle section |
| 8. | top of middle section |
| 9. | bottom of middle section |

-continued

| | |
|---|---|
| 10. | holding pocket |
| 11. | visor |
| 12. | top opening of holding pocket |
| 13a,b. | inside hook and loop fasteners |
| 14a,b. | outside matching hook and loop fasteners |
| 15. | thermally enhanced generating packets |
| 16. | pocket hook and loop fastening means |
| 17. | pocket snap fastening means |
| 18a,b. | handle snap fasteners |
| 19a,b. | snap fasteners on outer side |

Referring to the drawings, in FIG. 1 the sports towel 1 is shown as it might appear while being worn over the head. The sports towel would preferably be made of moisture absorbent cloth and have an outer side 2 and inner side 3 and a middle section 7 with a top 8 of one's head and a bottom 7 covering the neck. The sports towel would preferably have two narrower end sections 4*a* and 4*b* which would serve as handles to be held by one's hands to help hold the headwear to one's head. The end sections 4*a* and 4*b* may also be directed by the hand to wipe perspiration from the eyes and face of the wearer. An optional headband 5 on the inner side 3 near the top 8 would help place and secure the sports towel 1 over one's forehead. The outer side 2 of the sports towel 1 could serve as a medium for the display of advertising or logotypes 6, as desired.

Figure 2:
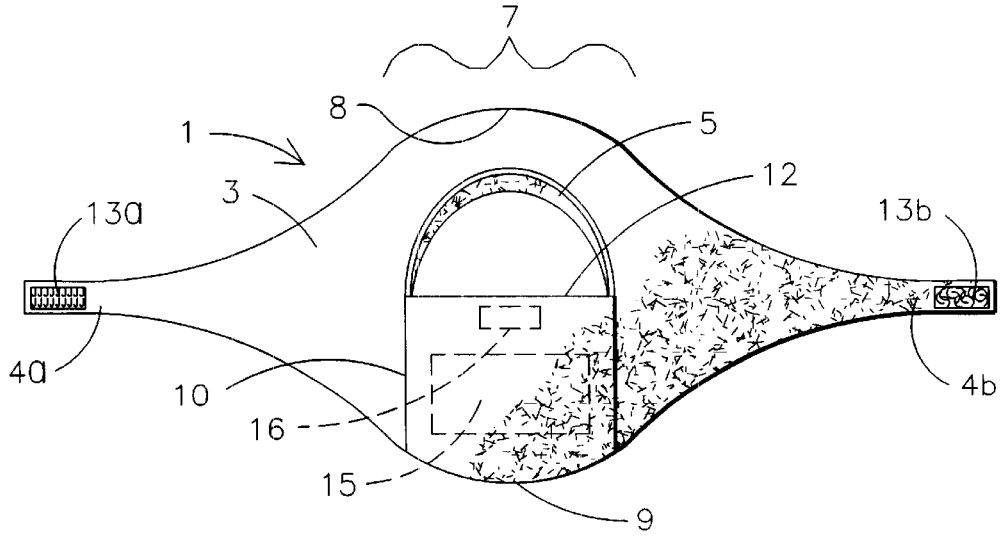
FIG. 2 is an elevation plan view of the inside of the sports towel with optional headband.
Figure 3:
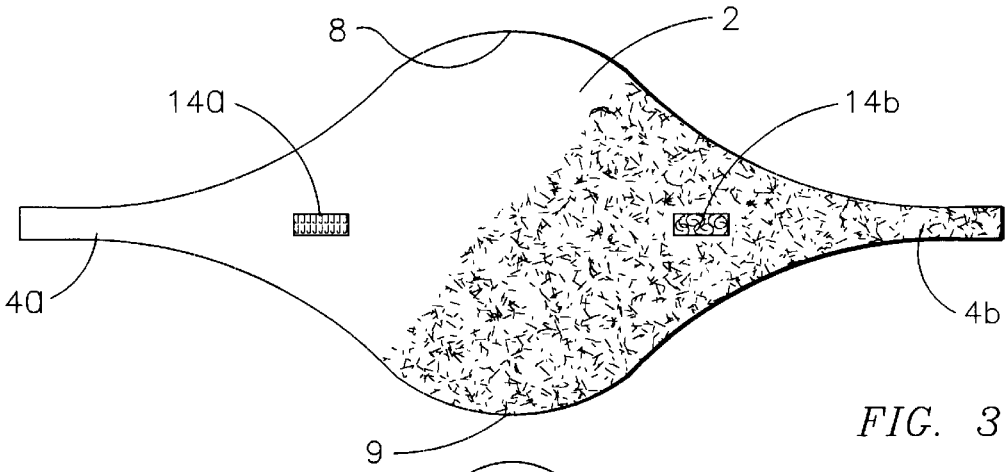
FIG. 3 is an elevation view of the outer side of the sports towel having hook and loop fastening means on the outside thereof.
Figure 4:
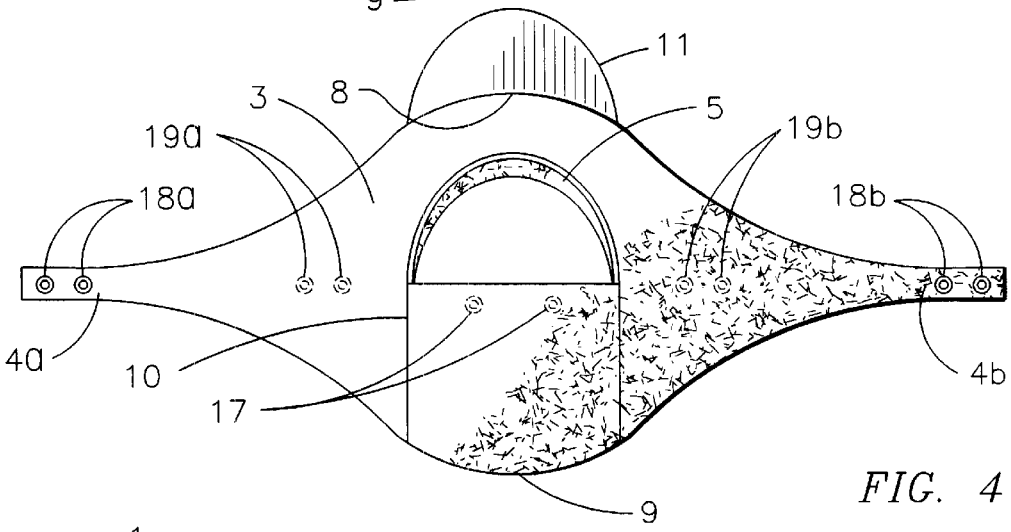
FIG. 4 is an elevation view of the outer side of the sports towel having snap fastening means on the outside thereof.

In FIG. 2 the inner side 3 of the sports towel 1 is shown. The inner side 3 bottom of the middle section 9 would contain a pocket 10 which can be sewn or otherwise sealed on the sides and has a top opening 12 into which one or more packets 15 of thermally enhanced or generating material, such as frozen liquid or heated matter is inserted. The pocket may have a closure fastening means 16, such as hook and loop fastening material or snaps as shown in FIG. 4. The handle end sections 4*a* and 4*b* may also contain hook and loop fastening material 13*a* and 13*b*, or, alternatively, snaps 18*a* and 18*b* as shown in FIG. 4 and used to secure the sports towel around one's neck by securing the hook and loop fastening material or snaps on said end sections 4*a* and 4*b* to matching fastening material 14*a* and 14*b* as shown in FIG. 3 or snaps as shown in 19*a* and 19*b* in FIG. 4. The latter fastening means would enable the sports towel to be held securely around one's head without having to use one's hands and in the event of windy weather.

Figure 5:
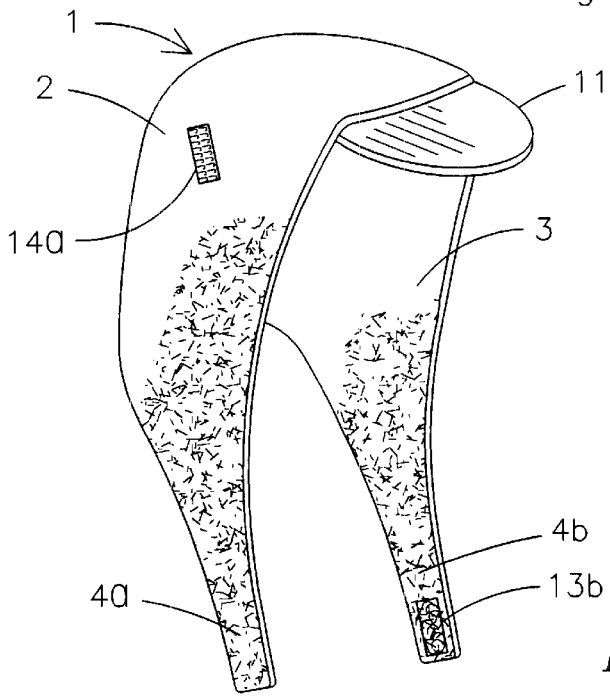
FIG. 5 is a side view of the sports towel of the present invention with optional visor.

FIG. 5 shows the sports towel 1 with an optional visor 11 which would help block the sun from one's eyes during wear of the sports towel 1 during outdoor events.

Although only some preferred embodiments of the present invention have been described in detail hereinabove, all improvements and modifications to this invention within the scope or equivalents of the claims are included as part of this invention.

We Claim:

1. An article of headwear comprising:

a piece of cloth having inner and outer sides, two narrow end sections and a wide middle section, said middle section having a top portion for covering a head and a lower portion for covering a neck of a wearer; and a pocket on the inner side of the lower portion of the middle section, said pocket having an opening on a top side for inserting thermal matters, wherein the two end sections are sufficiently narrow so as to form handles for holding by the hands of the wearer.

2. The article of headwear of claim 1 wherein the inner side of the top portion of the middle section has a semi-circular band positioned above the pocket, said band to assist in retaining the article of headwear over the forehead of the wearer.

3. The article of headwear of claim 1 further comprising a visor extending outward from the perimeter of the top portion of the middle section.

4. The article of headwear of claim 3 wherein the two end sections have fastening means and the outer side of the headwear has matching fastening means on each side so that each end section can be secured to an opposite side of the outer side of the middle section of the headwear in order to secure the headwear under the neck of the wearer.

5. The article of headwear of claim 4 wherein the fastening means comprises hook and loop fastening material.

6. The article of headwear of claim 4 wherein the fastening means comprises snaps.

7. The article of headwear of claim 1 further comprising a visor extending outward from the perimeter of the top portion of the middle section.

8. The article of headwear of claim 1 wherein the two end sections have fastening means and the outer side of the headwear has matching fastening means on each side so that each end section can be secured to an opposite side of the outer side of the middle section of the headwear in order to secure the headwear under the neck of the wearer.

9. The article of headwear of claim 8 wherein the fastening means comprises hook and loop fastening material.

10. The article of headwear of claim 8 wherein the fastening means comprises snaps.

11. The article of headwear of claim 1 wherein the pocket has fastening means on the top side to secure the opening in a closed position.

12. The article of headwear of claim 11 wherein the fastening means comprises hook and loop fastening material.

13. The article of headwear of claim 11 wherein the fastening means comprises snaps.

14. The article of headwear of claim 1 wherein the thermal matter comprises at least one packet of frozen liquid.

15. The article of headwear of claim 1 wherein the thermal matter comprises at least one packet of coolant.

16. The article of headwear of claim 1 wherein the thermal matter comprises at least one packet of matter which yields a warmer than ambient temperature.

17. The article of headwear of claim 1 wherein the outer side of the cloth serves as a medium for displaying advertising material.

18. An article of headwear of headwear comprising:

a piece of cloth having inner and outer sides, two narrow end sections and a wide middle section, said middle section having a top portion for covering a head and a lower portion for covering a neck of a wearer:

a pocket on the inner side of the lower portion of the middle section, said Docket having an opening on a top side for inserting thermal matter: and a visor extending outward from the perimeter of the top portion of the middle section.

* * * * *